US009822615B2

(12) United States Patent
Dotson et al.

(10) Patent No.: US 9,822,615 B2
(45) Date of Patent: Nov. 21, 2017

(54) APPARATUS AND METHOD FOR JET PERFORATING AND CUTTING TOOL

(71) Applicant: TD Tools, Inc., Woodburn, KY (US)

(72) Inventors: Thomas L. Dotson, Woodburn, KY (US); Lonnie S. Rhoads, Lafayette, LA (US); James F. Farr, The Woodlands, TX (US)

(73) Assignee: TD TOOLS, INC., Woodburn, KY (US)

( * ) Notice: Subject to any disclaimer, the term of this patent is extended or adjusted under 35 U.S.C. 154(b) by 425 days.

(21) Appl. No.: 14/026,103

(22) Filed: Sep. 13, 2013

(65) Prior Publication Data

US 2015/0075793 A1 Mar. 19, 2015

(51) Int. Cl.

| | |
|---|---|
| ***E21B 43/114*** | (2006.01) |
| ***E21B 47/10*** | (2012.01) |
| ***E21B 47/06*** | (2012.01) |
| ***E21B 23/02*** | (2006.01) |
| ***E21B 29/02*** | (2006.01) |

(52) U.S. Cl.

CPC ..... *E21B 43/114* (2013.01); *E21B 23/02* (2013.01); *E21B 29/02* (2013.01); *E21B 47/06* (2013.01); *E21B 47/1025* (2013.01)

(58) Field of Classification Search

CPC ..... E21B 43/114

See application file for complete search history.

(56) References Cited

U.S. PATENT DOCUMENTS

| | | | | |
|---|---|---|---|---|
| 1,481,651 | A | | 1/1924 | Nixon |
| 3,005,494 | A | | 10/1961 | Daffin |
| 3,130,786 | A | | 4/1964 | Brown et al. |
| 3,145,776 | A | | 8/1964 | Pittman |
| 3,266,571 | A | | 8/1966 | St. John et al. |
| 3,509,941 | A | * | 5/1970 | Davis et al. ..... 166/149 |
| 4,285,402 | A | * | 8/1981 | Brieger ..... E21B 33/1294 166/120 |
| 5,325,917 | A | * | 7/1994 | Szarka ..... 166/240 |
| 5,499,678 | A | | 3/1996 | Surjaatmadja et al. |
| 5,765,756 | A | | 6/1998 | Jordan et al. |
| 5,944,105 | A | * | 8/1999 | Nguyen ..... E21B 7/18 166/278 |
| 6,206,112 | B1 | | 3/2001 | Dickinson, III et al. |
| 6,336,502 | B1 | | 1/2002 | Surjaatmadja et al. |
| 6,564,868 | B1 | | 5/2003 | Ferguson et al. |

(Continued)

OTHER PUBLICATIONS

Cobbett, "Sand Jet Perforating Revistied", SPE Drill. & Completion, 14(1):28-33, 1999.

(Continued)

*Primary Examiner* — Robert E Fuller

(74) *Attorney, Agent, or Firm* — Norton Rose Fulbright US LLP

(57) ABSTRACT

A system and method for jet perforating within a well are disclosed. A jet perforating tool configured to be lowered inside a production tubing string comprises a tool body with a passage, an inlet in the upper section, perforating jets in the lower section, and a stepped outer diameter configured to seat on a production tubing string restriction such as a seat nipple. The tool may be lowered into the production tubing string without the need to trip the production tubing string in and out of the wellbore.

6 Claims, 8 Drawing Sheets

(56) References Cited

U.S. PATENT DOCUMENTS

| | | | | |
|---|---|---|---|---|
| 7,325,617 | B2 * | 2/2008 | Murray | E21B 23/02 166/153 |
| 7,497,259 | B2 | 3/2009 | Leising et al. | |
| 7,963,332 | B2 | 6/2011 | Dotson et al. | |
| 7,971,658 | B2 | 7/2011 | Buckman, Sr. | |
| 2008/0223585 | A1 * | 9/2008 | Patel | E21B 43/128 166/385 |
| 2010/0200230 | A1 | 8/2010 | East, Jr. et al. | |
| 2013/0213655 | A1 | 8/2013 | Martinez | |

OTHER PUBLICATIONS

Li et al., "Abrasive Water Jet Perforation—An Alternative Approach to Enhance Oil Production", Petrolium Science and Technology, 22(5 & 6):491-504, 2004.

Halliburton, "Hydra-Jet Perforating Process Service: A fast, effective alternate perforating method to access payzones that are beyond the reach of conventional perforating techniques", www.halliburton.com, Sep. 2006, 4 pages.

McDaniel et al., "Use of Hydrajet Perforating to Improve Fracturing Success Sees Global Expansion", SPE International, 114695:1-19, 2008.

Hebert et al., "Cutting Concentric Casting Strings with Sand Slurry", SPE International, 113734:1-6, 2008.

Loving et al., "Abrasive Cutting Technology Deployed via Coiled Tubing", SPE International, 92866:1-5, 2005.

Ousterhout, "Field Applications of Abrasive-Jetting Techniques", Journal of Petroleum Technology, 67:413-415, 1961.

Thru Tubing Solutions, "High Velocity Abrasive Cutter & High Velocity Abrasive Perforator", www.ThruTubing.com, Thru Tubing Solutions Catalogue, p. 26-27, 2006.

Tiw, "USR Horizongal Drilling System", Window Cutting Products, p. 74-75.

* cited by examiner

APPARATUS AND METHOD FOR JET PERFORATING AND CUTTING TOOL

BACKGROUND

1. Field of the Invention

This invention relates generally to the field of oil wells and other drilling operations. More particularly, the invention relates to the field of abrasive jet perforating in oil and gas wells.

2. Description of the Related Art

Abrasive jet perforating uses slurry pumped under high pressure to perforate tubular goods around a wellbore, where the tubular goods include tubing, casing, and cement. When sand is in the slurry, this technique may be known as sand jet perforating. Abrasive jet perforating has been used to extend a cavity into a surrounding reservoir to stimulate fluid production. Abrasive jet perforating has also been used to cut, such as to completely sever, the tubular goods into two pieces.

Perforating or cutting tubular goods, such as casing, drill pipe, and casing liners, is used within, for example, the oil and gas industry. Most engineering processes focused on the tools' ability to perform certain tasks, such as cutting slots. Conventionally, these tools are tubing conveyed, such as when attached to a production tubing string, which may be a string tripped out a producing well to attach to the tool. Jet perforating tools use a constant, pressurized fluid stream from the surface and receive fluid through a tubing string on which they are lowered.

Lowering the tool on a tubing string has several limitations. For example, the lowering of the string attached to the perforating tool is labor-intensive and can take several hours. In addition, before the perforating string can be lowered, the existing tools and production string already in the well must be removed before the perforating string may be lowered. Likewise, the perforating string must then be removed from the well and the tubing string then reinserted along with the production tools.

As an example, performing perforating or cutting jobs in a producing well with a production tubing string and pump tools such as pump rods and a pump in place in the well would typically comprise the following process: (1) run the pump rods and pump out of the well; (2) run the production tubing string out of the well; (3) run a jet perforating tool into the well on a production tubing string; (4) perform a perforating or cutting job with the jet perforating tool; (5) run the jet perforating tool out of the well on the production tubing string; (6) run the production tubing string back into the well; and (7) run the pump rods and pump back into the well.

Each of steps 2, 3, 5, and 6 involve the process of running production tubing into or out of the well. These processes typically may take several or more hours to perform. The deeper the well, the longer these processes take. Thus, these conventional methods for performing these well operations are time consuming and expensive, especially for deeper wells.

Certain modifications to the aforementioned process have reduced the time to run a jet perforating tool into the well. For example, temporary tubing work strings may be used, such as coiled tubing. Coiled tubing cuts the trip time associated with running conventional production tubing into and out of the well. But, coiled tubing is costly in its own right and requires a secondary system to be on location at the well site.

BRIEF SUMMARY

There is disclosed an apparatus and a method for performing jet perforating in a well. One embodiment of the jet perforation tool is a tool body designed to fit inside a tubing string, such as a tubing string. The tubing string may be either a production tubing string or a pipe brought to the well to use with the tool, such as a jointed pipe. The tool has a stepped outer diameter configured to rest or sit on a tubing string restriction, such as a seat nipple. The tool can be lowered, dropped, or pumped down the tubing string until it comes to rest on the seat nipple. The tool also has one or more inlets in its upper section. Fluid, such as abrasive cutting slurry, may be pumped into the inlets. The fluid travels through the inside of the tool body past outer seat seals that seal the upper portion of the tool against a portion of the tubing string, such as the restriction. The fluid then exits holes in the side of the lower section of the tool. These holes can be outfitted with various heads such as cutting jets or perforating jets of various geometries. In addition, the fluid may be diverted into a nose piece such as a circulation sub or a wash tool. In the alternative, the holes in the lower section of the tool can be plugged so that it can be used for pressure testing.

This method of jet perforation can save time and money. Rather than tripping the entire production tubing string in or out of the well four times, the tubing string is simply positioned at the targeted cutting or perforating depth, the existing pump tools and the like are run out of the well, and the jet perforating tool is lowered, dropped, or pumped into the well. Fluid is pumped into the existing tubing string to perform the perforation. The tubing string or the tool itself may be rotated for cutting purposes. The tool is then run out of the well such as by wireline, and the tubing string may be repositioned, if desired, to a desired depth. Pump tools are then run back into the tubing string.

In one embodiment, there is provided an apparatus for performing abrasive jet perforating. The apparatus may include a tubular tool body having an upper section and a lower section, an inlet in the upper section, the inlet configured to accept jet cutting fluid, a stepped outer diameter portion configured to rest on a restriction within an oilfield tubing string, at least one seat seal, wherein the at least one seat seal separates the upper section from the lower section, at least one hole in the lower section, a passage through at least part of the tool body connecting the inlet to the at least one hole, and a jet affixed to at least one hole.

In one embodiment, the apparatus may also include a nose piece which can be closed off for pressure testing purposes, or can be open to act as a circulation sub or as a wash tool. The apparatus may have a threaded connection fitting used to attach the nose piece to the jet perforating tool body. In one embodiment, there is further disclosed a retrieval rod. In another embodiment, the stepped outer diameter comprises multiple steps. The seat seal may take the form of an o-ring and may consist of plastic, rubber, compressed fiber, metal, polytetrafluoroethylene, graphite, vermiculite, cork, felt, neoprene, and fiberglass.

In another embodiment, there is disclosed a method for performing jet perforating such as with an abrasive fluid slurry. The method may include removing pump tools, such as pump rods and a pump from the well, positioning a production tubing string at a desired perforating or cutting depth in the well, running a jet perforating tool into the production tubing string until a stepped outer diameter portion of the jet perforating tool is resting on a restriction within the production tubing string, perforating a portion of the well with the perforating jet tool, running the jet perforating tool out of the well, positioning the production tubing string at a desired production depth, and running pump tools such as pump rods and a pump into the well. According on one embodiment, jet cutting fluid is pumped down the production tubing string into the inlet, where it travels through a passage in the tool body of the jet perforating tool to perforating jets.

The jet perforating and cutting method and apparatus, and variants thereof, have numerous advantages. In particular, the tool greatly reduces the number of runs for bringing a production tubing string in and out of the well. Time, as well as cost, may be saved from the reduced work for the workover equipment. Furthermore, a secondary system such as coiled tubing system is not required.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and any specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION

A wireline-conveyed jet perforating tool allows the jet perforating tool to be lowered and raised through a production tubing string, with the tool sealed in a seat or restriction already located in the string, to allow the fluid to be pumped to the tool. The tool can then be used for perforating or cutting casing or tubing. Operation of the wireline-conveyed jet perforating tool provides faster performance of abrasive jet perforating or cutting in wells. An apparatus for performing jet perforating and cutting may include a stepped outer diameter. The tool may circulate, wash, and pressure test. The jet perforating and cutting may be performed with abrasive fluid.

Figure 1:
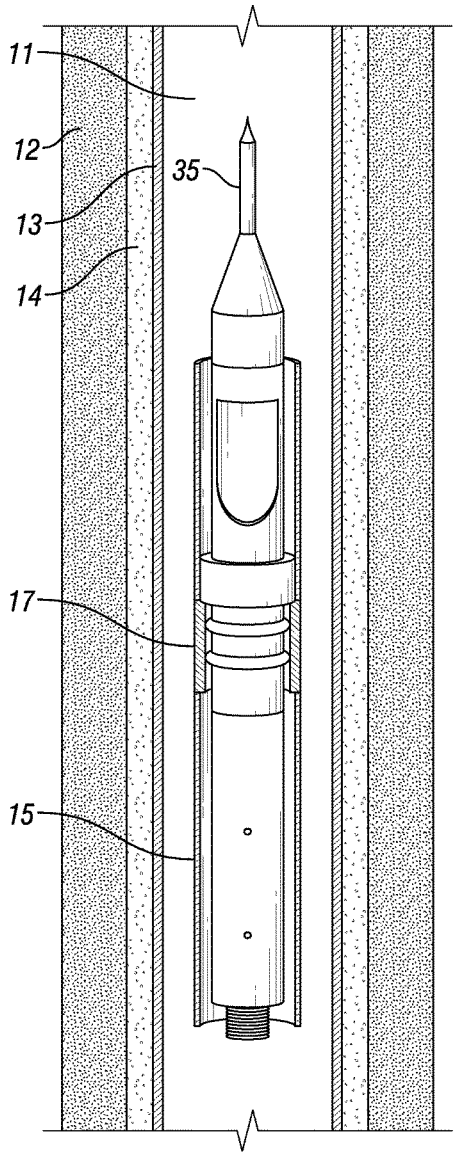
FIG. 1 shows a schematic side view of a jet perforating tool, according to one embodiment.

FIG. 1 shows a schematic side view of a jet perforating tool in a wellbore according to one embodiment. A jet perforating tool 10 is shown suspended in a wellbore 11 that is penetrating a reservoir 12. The wellbore 11 is surrounded by a casing 13, which in turn is surrounded by cement 14, fixing the casing 13 to the reservoir 12. A production tubing string 15 extends vertically downward into the wellbore 11. The jet perforating tool 10 sits in a restriction (seat) 17 at the lower end of the production tubing string 15. In one embodiment, the restriction 17 is a seating nipple. Jet perforating tool 10 may be placed in the production tubing string in a number of ways. According to one embodiment, jet perforating tool 10 is lowered by wireline (not shown), which extends down through the production tubing string 15. When the wireline remains in place during perforating, the wireline may exit the top of the wellbore 11 through a lubricator or pack-off (not shown). The jet perforating tool 10 may be suspended from the wireline, or the wireline may be retracted, leaving jet perforating tool 10 seated in restriction 17. According to another embodiment, jet perforating tool 10 may be dropped into the production string 15. In yet another embodiment, jet perforating tool 10 may be pumped into the production string 15, such as in highly deviated wells.

Figure 2:
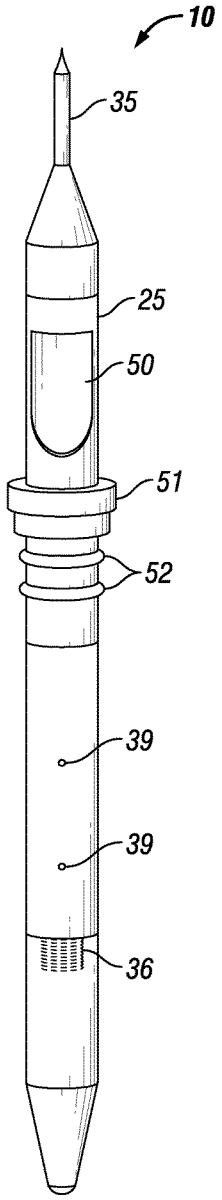
FIG. 2 shows a schematic side view of an embodiment of the jet perforating tool with a nose.

FIG. 2 illustrates one embodiment of a jet perforating tool with a nose. Jet perforating tool 10 includes retrieval rod 35, fluid inlet 50, seat no-go 51, seat seals 52, jets 39, and threaded connection 36. Depending on the specific application, the general embodiment may use one or more variations to this basic configuration. Retrieval rod 35 may be affixed to the wireline during lowering or raising of jet perforating tool 10. In the alternative, wireline or another extraction means may be affixed to retrieval rod 35 within the wellbore, such as with an oilfield fishing apparatus (not shown) like the Logan Oil Tools Series 20 Sucker Rod Overshot. Although not discussed, other tool capturing devices may be used to secure the jet perforating tool and remove it from the tubing string. For example, one capturing tool may include a fishing neck on the top of the tool and a latch-type retrieval tool that would lock onto it for retrieval. Another example of a capturing tool may include a grapple, which is part of a larger class of fishing tools called overshots, designed to fit over a tool in the hole and grab onto it for retrieval. One example of such a grapple is the Weatherford Heavy Duty GS.

Stepped outer diameter 51, which may be a seat no-go, is configured to rest on restriction 17. The weight of jet perforating tool 10 or the fluid pressure of the pumped fluid holds seat no-go 51 against seat nipple 17. In addition to the stepped outer diameter other configurations may be used. For example, the stepped outer diameter may be specifically shaped to mate with the type of restriction or fitting present in the tubing. According to another embodiment, jet perforating tool 10 may have a gradual increase in outer diameter towards the upper section of the tool. When operating under high pressure, a gradual outer diameter increase can cause the jet perforating tool to become stuck in the production tubing string. The stepped outer diameter 51 may reduce the likelihood of the tool becoming stuck. To account for multiple restriction designs, stepped outer diameter 51 may include multiple steps, thereby allowing one jet perforating tool to properly seat on different sized production tubing restrictions.

The stepped outer diameter 51 holds jet perforating tool 10 in place against seat nipple 17. Additional seat seals 52 may improve sealing of the seat seals 52 against the inner diameter of seat nipple 17. In one embodiment, seat seals 52 are rings of a moderately malleable material, such as plastic or rubber. Seat seals 52 may slide onto jet perforating tool 10 and rest within a notched outer diameter such as a mandrel (not shown). Seat seals 52 may comprise other materials known in the art of tool sealing, such as compressed fiber, metal, rubber, polytetrafluoroethylene, graphite, vermiculite, cork, felt, neoprene, fiberglass, or any other material known in the art of gasket or sealing ring design. In one embodiment, seat seals 52 may take the form of plastic polymer o-rings affixed to perforating jet tool 10 within a mandrel. Seat seals 52 may also take alternate forms such as sealing jackets, inflatable compression balloons, or other sealing devices. Other sealing devices may include seals, packer, or plug-type seals. A packer may be inflatable, and a plug may include a rubber material, which may be compressed to make it expand and seal. According to another embodiment, seat no-go 51 may contain seat seal 52 on the underside of the no-go 51. In this embodiment, the compression seat seal 52 between no-go 51 and seat nipple 17 may prevent leakage of abrasive jet fluid or any alternative fluid within the system. In another embodiment, seat seal 52 may be located on the outer side of seat no-go 51 or on the side of upper portion 25 of the tool body, below inlet 50.

The jet perforating tool 10 may include jets 39, such as abrasive jets. The jets 39 eject jet cutting fluid such as abrasive-carrying slurry under high pressure to perforate the casing 13, cement 14, and reservoir 12. The jets 39 may perforate a cavity into the reservoir 12 through the cement 14 and casing 13 with the wellbore 11. This cavity may provide improved fluid flow from the reservoir 12 to the wellbore 11, preferably from a zone in the reservoir 12 producing oil or gas. In an alternative situation called an openhole wellbore, there is no casing 13 or cement 14, so the wellbore 11 may directly contact the reservoir 12. In an alternative use, the jet perforating tool 10 is used to cut (sever) the casing 13, cement 14, or production tubing string 15.

This use of the jet perforating tool 10 as a perforating tool is further described in U.S. Pat. No. 7,963,332, "Apparatus and Method for Abrasive Jet Perforating," issued Jun. 21, 2011, which is incorporated by reference. This use of the jet perforating tool 10 as a cutting tool is further described in co-pending U.S. patent application Ser. No. 12/653,803, "Apparatus and Method for Abrasive Jet Perforating and Cutting of Tubular Members," filed Dec. 18, 2009, which is incorporated by reference.

Figure 4:
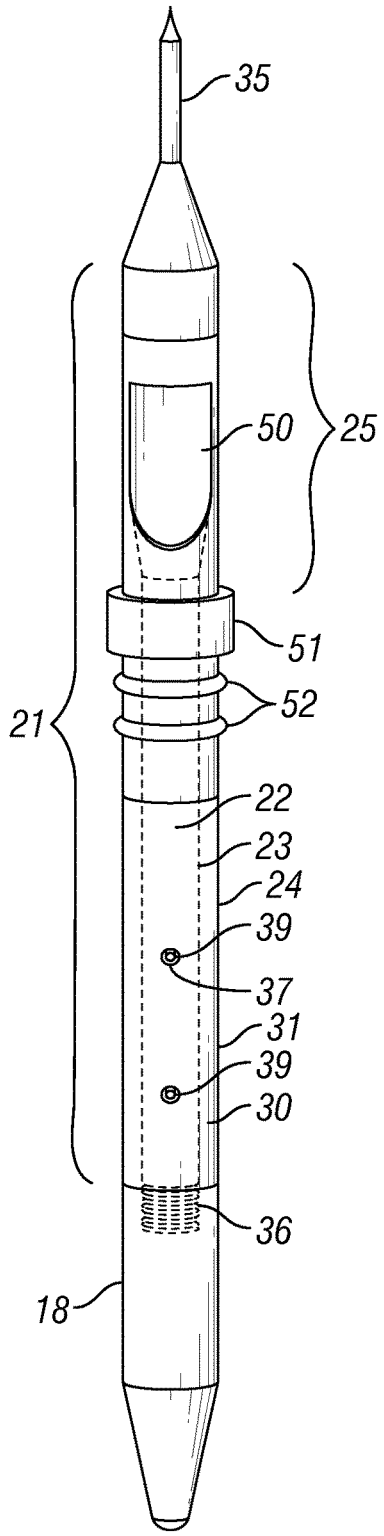
FIG. 4 shows a schematic side view of an alternative embodiment of the jet perforating tool.

FIG. 4 shows a schematic side view of the abrasive jet perforating tool according to one embodiment. The jet perforating tool 10 may include a main tool body 21 and the nose piece 18. The main tool body 21 of the jet perforating tool 10 may include a conduit, such as in the form of a cylindrically-shaped tube with a passage 22 extending at least a portion of the length of the tool body 21, or the entire length as seen in FIG. 4. The passage 22 has an inner diameter 23 and the tool body 21 has an outer diameter 24. Although the jet perforating tool 10 is illustrated here with the tool body 21 as a tube, the tool body 21 may take shape other than a cylindrical shape.

The tool body 21 may include an upper section 25 and a lower section 30 with a side 31. Both sections 25 and 30 are connected together with the passage 22 extending throughout at least a portion of the sections 25 and 30. According to one embodiment, the nose piece 18 has a threaded connection fitting 36 located at the upper end of the nose piece 18 and may be affixed to tool body 21 by way of the threaded connection fitting 36. In one embodiment, the passage 22 may not extend through the nose piece 18.

The lower section 30 of tool body 21 may include a threaded connection fitting 36. Nose piece 18 contains a connection fitting configured to mate to threaded connection fitting 36. Passage 22 may extend through threaded connection fittings 36 into nose piece 18. In one embodiment, the nose piece 18 may be solid and rounded on the bottom end to act as a guide through the production well tubing string 15 and to add weight to the jet perforating tool 10. The upper end of tool body 21 is coupled to retrieval rod mechanism 35. Additional weight or ballast may be placed within upper section 25 of jet perforating tool 10.

Located below seat seals 52 is lower section 30. Lower section 30 contains at least one hole 37 in the side 31 of jet perforating tool 10. In one embodiment, jet perforating tool 10 will have a plurality of the holes 37 in multiple locations of lower section 30. As illustrated in FIG. 4, the holes 37 are oriented in a direction that is perpendicular, or near perpendicular, to the longitudinal axis of the tool body 21. Jets 39 are mounted in the holes 37 in the side 31 of the lower section 30.

In one embodiment, the holes 37 are threaded holes tapped into the side 31 of the lower section 30. In this embodiment, the jets 39 comprise threaded jets mounted in at least some of the threaded holes 37 in the side 31 of the lower section 30. The jets may be protected from the splash back of abrasive-carrying fluid slurry ejected by the jets 39 by protective plates (not shown) mounted on the side 31 of the lower section 30 around the jets 39. This use of threaded jets 39 is described in one example in U.S. Pat. No. 7,963,332, "Apparatus and Method for Abrasive Jet Perforating," issued Jun. 21, 2011, which is incorporated by reference.

In another embodiment, the holes 37 are smooth holes drilled into the side 31 of the lower section 30. In this embodiment, the jets 39 comprise smooth jets mounted in at least some of the smooth holes 37 in the side 31 of the lower section 30. In this embodiment, the jets 39 are held in place by protective plates (not shown) mounted around the jets 39 and secured by fasteners (not shown), such as screws, to the side 31 of the lower section 30. The fasteners are positioned away from the splash back of abrasive-carrying fluid slurry ejected by the jets 39. This use of smooth jets 39 is described in co-pending U.S. patent application Ser. No. 13/507,971, "Apparatus and Method for Abrasive Jet Perforating," filed Aug. 9, 2012, which is incorporated by reference.

FIG. 4 further illustrates an exemplary embodiment according to aspects of the present disclosure. Jet perforating tool 10 includes at least one inlet 50 located in a section of the jet perforating tool 10 above seat seals 52. Inlet 50 connects to passage 22. According to one embodiment, abrasive slurry pumped into the resident tubing string (not shown) enters inlet 50 and exits jets 39. Jet perforating tool 10 may have one or more inlets 50.

Figure 3:
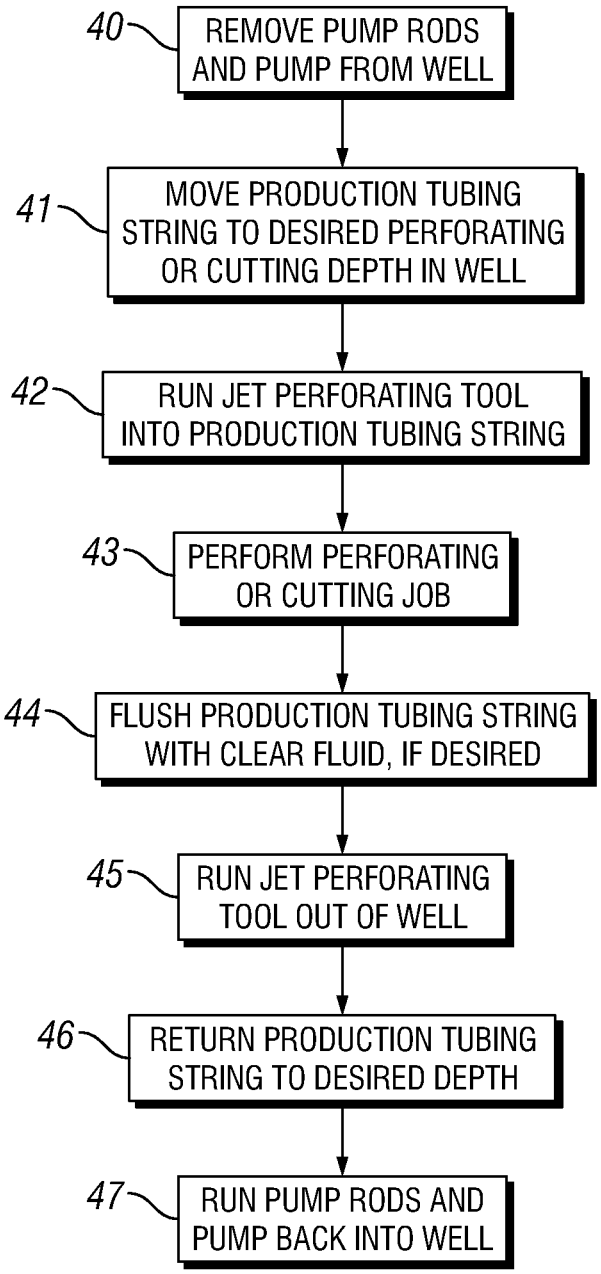
FIG. 3 shows a flowchart illustrating an example embodiment of a method for performing perforating or cutting jobs in a well.

A method for performing abrasive jet perforating cutting may use the jet perforating tool described above. FIG. 3 is a flowchart illustrating a method for performing perforating or cutting jobs in a well. The following is one method by which the perforating or cutting will be performed on a well with the production tubing string, the pump rods, and a pump still present in the casing. By way of example, the following method is disclosed according to use of jet perforating tool 10.

At block 40, pump rods and pump are removed from the well. Any other items that may be inside the production tubing string may also be removed. At block 41, the production tubing string is raised or lowered to the desired perforating or cutting depth in the well, if necessary. At block 42, jet perforating tool 10 is run into the production tubing string. This may be performed using a wireline until it comes to rest and seats on the restriction 17, such as a seating nipple. In the alternative, jet perforating tool 10 may be dropped into the tubing string or pumped into the tubing string until the tool 10 comes to rest and seats on restriction 17. This process of installing the jet perforating tool 10 inside the tubing string may take minutes to perform, much shorter than the hours it typically would take to use the production tubing string to lower the tool.

Prior to lowering the tool at block 42, parameters may be determined for a well to be perforated or cut. These well parameters may include, but are not limited to, the type and thickness of casing, the type and thickness of cement, the type of reservoir rock to be encountered in the zones to be perforated, and the depth of the zones to be perforated or tubing to be cut. These parameters may be used when assembling the appropriate components of a jet perforating tool. The assembly of the tool can take place onsite or offsite. If the tool is assembled offsite, then the tool may be shipped to the well site, where the tool assembly can be easily changed if the well parameters have changed or turn out to be different than originally expected.

At block 43, a perforating job is performed by pumping abrasive fluid slurry through the production tubing string and the jet perforating tool. The jet perforating tool could also be used for cutting by rotating the tubing from the surface. The jet perforating tool can also be used to slot, either vertically or horizontally by manipulating the tubing from the surface with a workover unit. In configurations where the wireline stays attached to the jet perforating tool, the wireline exits the tubing at the surface through a lubricator.

The production tubing string may be flushed with clear fluid, such as without abrasives, as shown at block 44, until the production tubing string and the jet perforating tool are flushed and sand is returned to surface. Jet perforating tool 10 may be returned to the surface without first flushing the apparatus with clear fluid.

At block 45, the jet perforating tool is run out of the well using the wireline. This process of removing the jet perforating tool using a wireline typically takes minutes to perform, much shorter than the hours it typically would take to use the production tubing string to remove the tool. Depending on the method used to deploy jet perforating tool 10, block 45 may include the additional step of connecting a wireline or other extraction means to jet perforating tool 10 by use of an oilfield fishing apparatus (not shown) like the Logan Oil Tools Series 20 Sucker Rod Overshot.

After the jet perforating tool is removed, the production tubing string is returned to a desired depth at block 46, and, at block 47, the pump and pump rod are run back into the well.

The jet perforating and cutting method and apparatus described here has numerous advantages. In particular, the tool greatly reduces the number of runs for bringing a production tubing string in and out of the well. Time, as well as cost, is saved from the reduced work for the workover equipment. Furthermore, a secondary system such as coiled tubing is not required. These savings can be seen in the following comparison.

Existing methods of jet perforating lower the jet perforating tool on a tubing string, requiring the production tubing string to be removed and then reinserted. In addition, the jet perforation tool is lowered and removed on a tubing string as well. This conventional method requires the workover unit to either trip in or trip out the production tubing string four times. On a well that is 5,000 feet deep, this conventional process would take at least 2 hours for each trip. By contrast, the method as disclosed is now much shorter. In particular, moving the production string to a new depth would only take minutes compared with the hours required to run the production tubing string into and out of the well. Similarly, running the jet perforating tool into or out of a well with a wireline would take only minutes compared with the hours required to run the production tubing string into and out of the well.

Depending on the specific application, alternative embodiments of the abrasive jet perforating tool 10 may use one or more variations to the general embodiment illustrated in FIG. 2. Some of these possible alternative embodiments are illustrated in FIGS. 5-7.

Figure 5A:
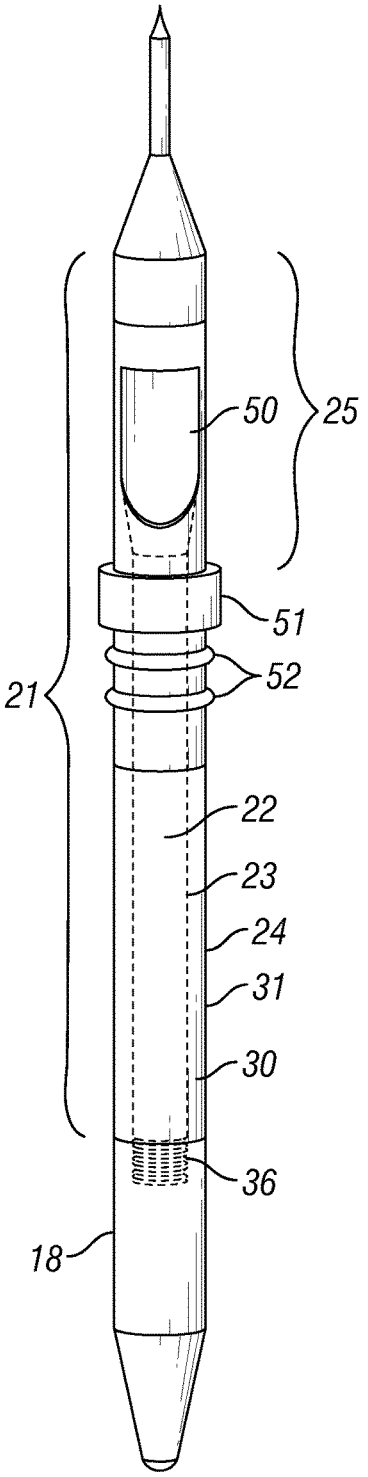
FIGS. 5A and 5B show schematic side views of embodiments of the jet perforating tool having a pressure tester.
Figure 5B:
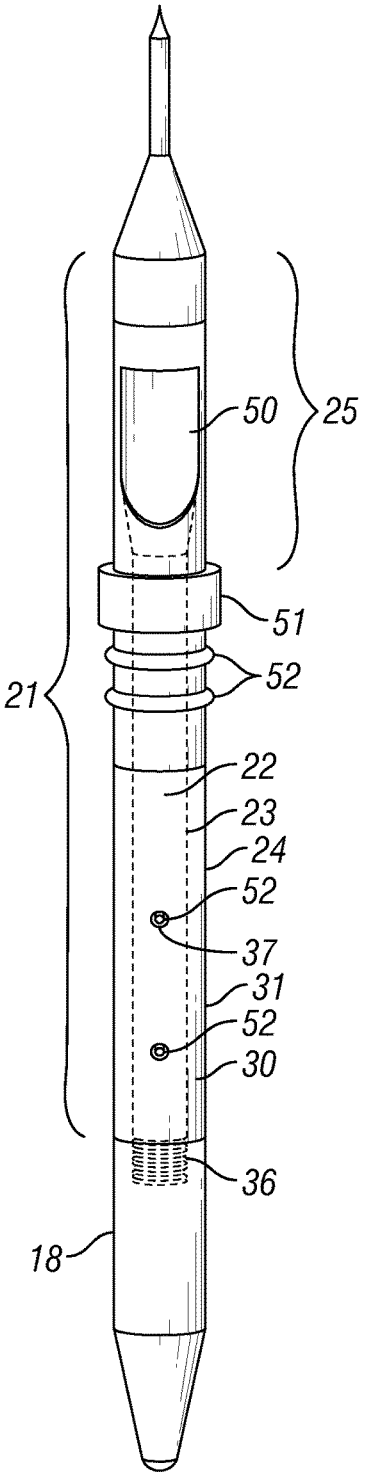

FIGS. 5A and 5B show schematic side views of other alternative embodiments of the tool configured as a pressure tester. In some embodiments, the tool body 21 has no ports in the side 31 of the lower section 30. In the embodiment illustrated in FIG. 5A, the tool body 21 may have no holes 37 in the side 31 of the lower section 30 and have no jets. In another embodiment illustrated in FIG. 5B, the tool body 21 has all the jets 39 that are mounted in the holes 37 in the side 31 of the lower section 30 but with plugs 52 inserted. These embodiments of the tool body 21 allow the jet perforating tool 10 to be used as a pressure tester. Pressure testing may be used to ensure tubing integrity of the production tubing string 15.

Figure 6A:
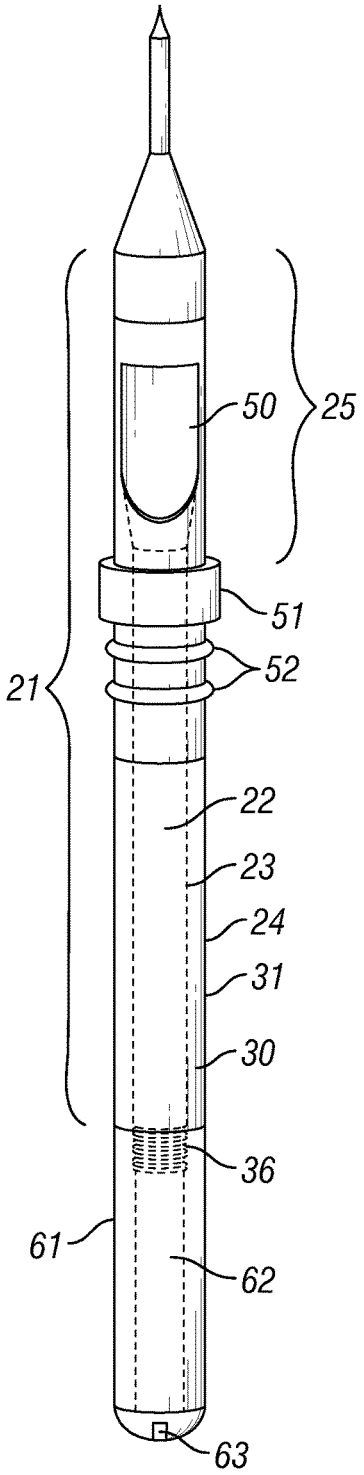
FIGS. 6A and 6B show schematic side views of embodiments of the jet perforating tool having a circulation sub.
Figure 6B:
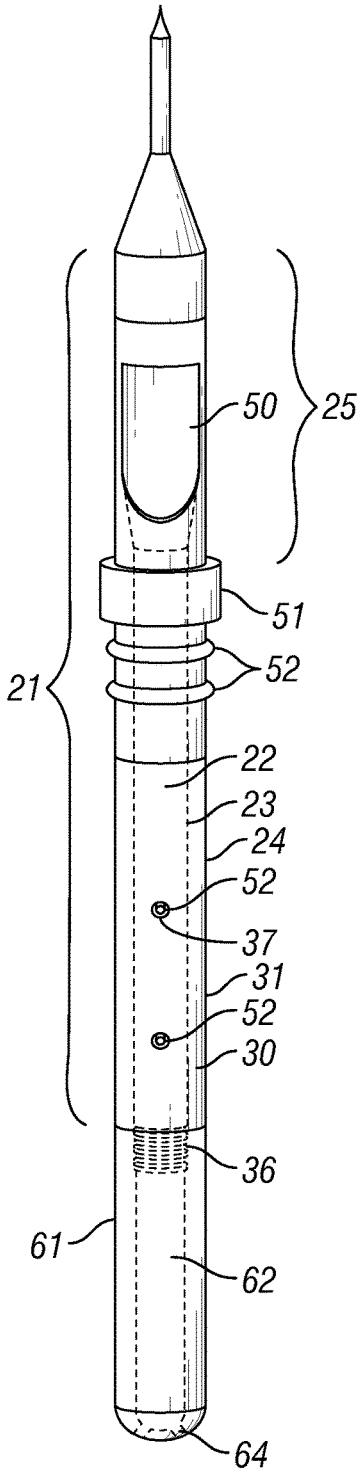

FIGS. 6A and 6B show schematic side views of other alternative embodiments of the jet perforating tool configured as a circulation sub. In these embodiments, the nose piece may be replaced by a circulation sub 61. The circulation sub 61 may include a passage 62 extending throughout and connecting to the passage 22 through the tool body 21.

In one embodiment illustrated in FIG. 6A, the circulation sub 61 has a forward-facing flow exit path 63. In another embodiment illustrated in FIG. 6B, the circulation sub 61 has a plurality of forward-angled flow exit paths 64 to facilitate fluid circulation to clean out the well. In either embodiment, the tool body 21 may have no holes in the side 31 of the lower section 30 and no jets, as illustrated in FIG. 6A, or the tool body 21 could have all the jets that are mounted in the holes 37 in the side 31 of the lower section 30 with plugs 52 inserted, as illustrated in FIG. 6B.

Figure 7A:
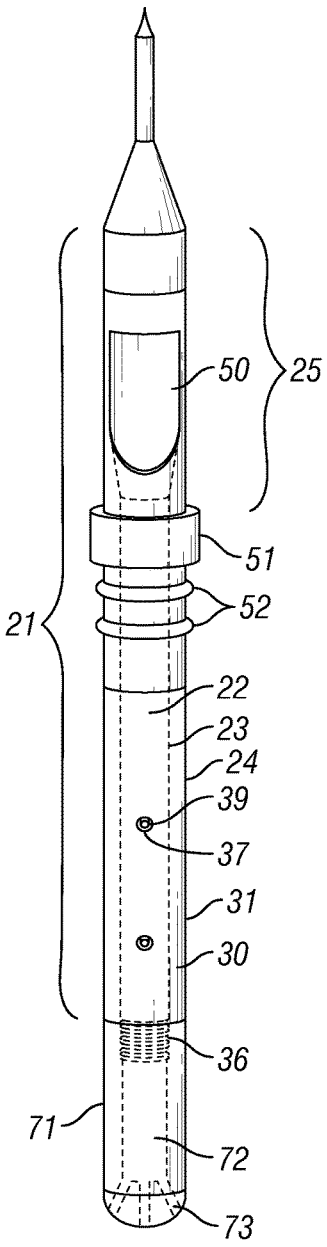
FIGS. 7A, 7B, and 7C show schematic side views of embodiments of the jet perforating tool having wash tool.
Figure 7B:
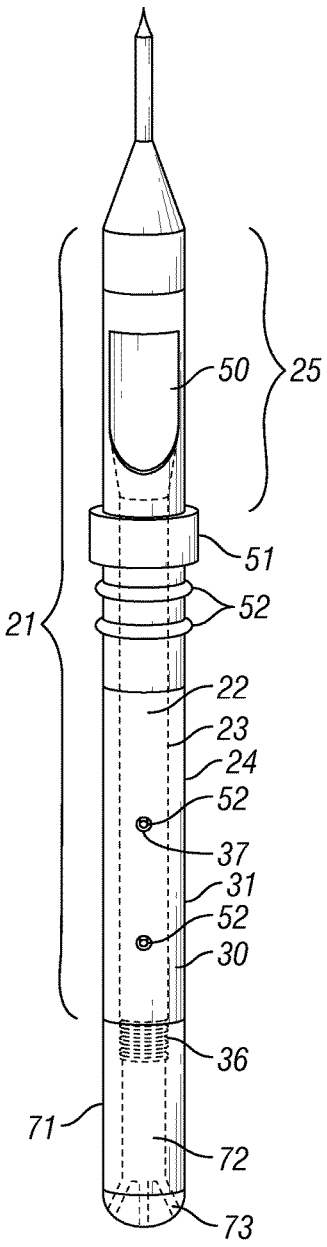
Figure 7C:
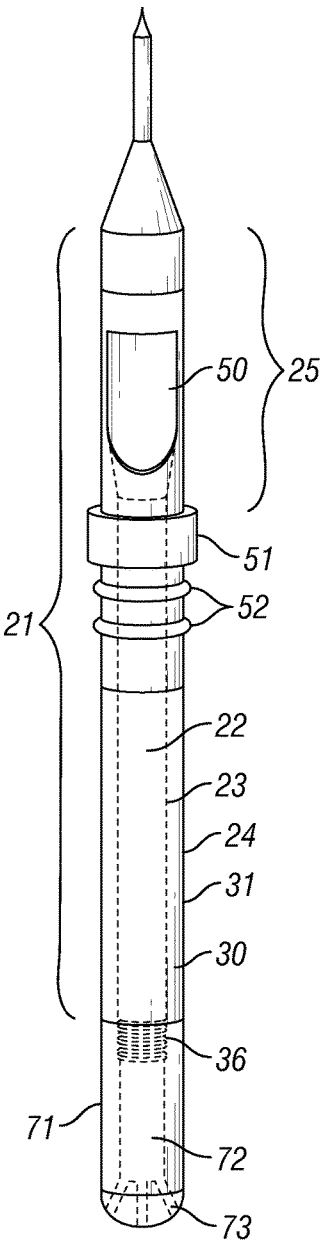

FIGS. 7A, 7B, and 7C show schematic side views of other embodiments of the jet perforating tool configured as a wash tool. In these embodiments, the nose piece may be replaced by a wash tip 71. The wash tip 71 may have a passage 72 extending throughout. The wash tip 71 may also include a plurality of forward-angled jets 73 acting as flow exit paths to circulate fluid and clean out the well.

In one embodiment illustrated in FIG. 7A, the lower section 30 of the tool body 21 has the jets 39 in the holes 37 in the side 31 acting as side jets to assist the plurality of forward-angled jets 73 in the wash tip 71. In another embodiment illustrated in FIG. 7B, the lower section 30 of the tool body 21 has plugs 52 inserted in the jets 39 to force additional fluid through the plurality of forward-angled jets 73 in the wash tip 71. In another embodiment illustrated in FIG. 7C, the lower section 30 of the tool body 21 has no jets to force additional fluid through the plurality of forward-angled jets 73 in the wash tip 71.

A variety of different jet quantities, orifice sizes, and placement locations can be used with the embodiments illustrated above in reference to FIGS. 1-2 and 4-7 for this tool. Additionally, different materials could be used in the making of the various apparatuses described.

Figure 8A:
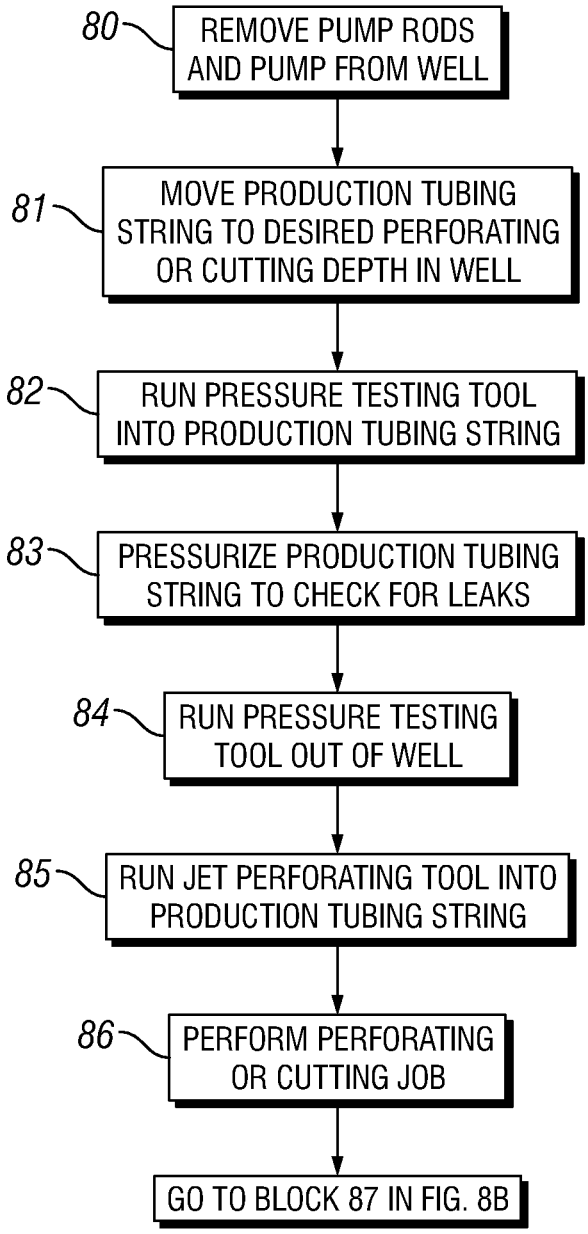
FIGS. 8A and 8B show flowcharts illustrating an example embodiment of a method for performing well jobs.
Figure 8B:
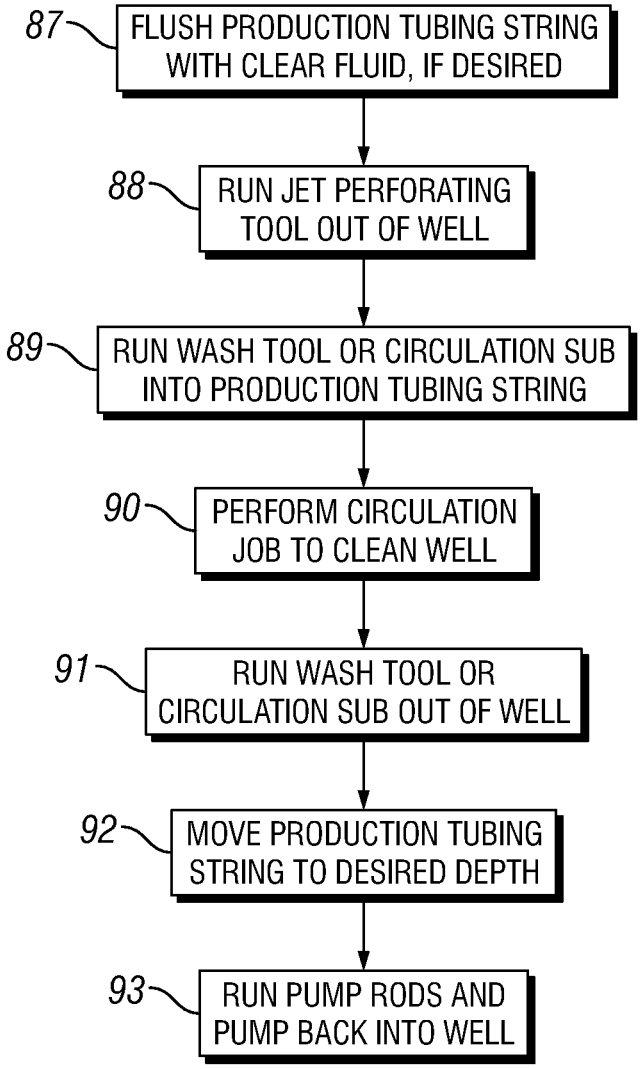

FIGS. 8A and 8B show flowcharts illustrating an example embodiment of a method for performing well jobs using some of the additional embodiments shown in FIGS. 4-7.

At block 80 in FIG. 8A, pump rods and pump are run out of the well. Any other items that may be inside the production tubing string are also removed.

At block 81, the production tubing string is moved to the desired perforating or cutting depth in the well. The production tubing string may be raised or lowered as necessary.

At block 82, a pressure testing tool is run into the production tubing string until the tool comes to rest and seats on the restriction, which may be a seating nipple, at the bottom end of the production tubing string. This may be accomplished via wireline, or by dropping or pumping the tool down the tubing string. The pressure testing tool can be either the no-jet tool shown in FIG. 5A or the jet perforating tool with plugs in all the abrasive jet locations shown in FIG. 5B.

At block 83, the production tubing string is pressurized to check for leaks.

At block 84, the pressure testing tool is run out of the well.

At block 85, a jet perforating tool is run into the production tubing string until it comes to rest and seats on the restriction located within the production tubing string. This may be accomplished in one embodiment by lowering the jet perforating tool on a wireline. In the alternative, the jet perforating tool may be dropped into the production tubing string. In yet another embodiment, the jet perforating tool may be pumped down the well until it comes to rest on the restriction.

At block 86, a perforating or cutting job is performed by pumping abrasive fluid slurry through the production tubing string and the jet perforating tool. In one embodiment, the wireline may stay attached to the jet perforating tool and the abrasive fluid may exit the tubing at the surface through a lubricator. The process then proceeds to block 87 in FIG. 8B.

The production tubing string may be flushed with clear fluid, such as with no abrasives, as shown in block 87, until the production tubing string and the jet perforating tool are flushed and sand is returned to surface. The jet perforating tool may also be returned to the surface without first flushing the apparatus with clear fluid.

At block 88, the jet perforating tool is run out of the well using the wireline.

At block 89, the wash tool or circulation sub tool is run into the production tubing string using a wireline until it comes to rest and seats on the restriction at the bottom end of the production tubing string.

At block 90, a desired circulation job is performed to clean the well.

At block 91, a wash tool or circulation sub tool is run out of the production tubing string.

At block 92, the production tubing string is moved to a desired depth. The production tubing string may be raised or lowered, as necessary.

At block 93, the pump rods and pump are run back into the well.

Lowering and removing the tools with the wireline, as described in certain embodiments in FIGS. 8A and 8B, is a process that takes only a few minutes as opposed to running the production tubing string into and out of the well, which takes hours.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A jet perforating tool comprising:

a tubular tool body having an upper section and a lower section;

an inlet in the upper section, the inlet configured to accept jet cutting fluid from pressurized jet cutting fluid in a production tubing string surrounding the tubular tool body;

a stepped outer diameter portion configured to rest on a restriction seat nipple within the production tubing string, wherein the stepped outer diameter comprises multiple steps configured with steps that fit a plurality of differently-sized seat nipples of different production tubing strings;

at least one seat seal, wherein the at least one seat seal is positioned between the tubular body and the restriction seat nipple and configured to seal the tubular body to the seat nipple of the production tubing string under application of pressure from a pressurized fluid in the production tubing string;

at least one hole in the lower section;

a passage through at least part of the tool body connecting the inlet to the at least one hole;

a jet affixed to at least one hole; and a retrieval rod configured to facilitate tool retrieval.

2. The jet perforating tool of claim 1, further comprising a nose piece.

3. The jet perforating tool of claim 2, wherein the nose piece is selected from the group consisting of a pressure tester, a circulation sub, and a wash tool.

4. The jet perforating tool of claim 3, further comprising a threaded connection fitting connecting the tool body to the nose piece.

5. The jet perforating tool of claim 1, wherein the seat seal is selected from the group consisting of plastic, rubber, compressed fiber, metal, polytetrafluoroethylene, graphite, vermiculite, cork, felt, neoprene, and fiberglass.

6. The jet perforating tool of claim 1, wherein the seat seal is an o-ring.

* * * * *